US010829252B2

(12) United States Patent
Trilli et al.

(10) Patent No.: US 10,829,252 B2
(45) Date of Patent: Nov. 10, 2020

(54) METHOD AND MACHINE FOR FILLING AND SEALING BOTTLES, CARTRIDGES, SYRINGES AND THE LIKE

(71) Applicant: I.M.A. INDUSTRIA MACCHINE AUTOMATICHE S.P.A IN SIGLA IMA S.P.A., Ozzano Dell'Emilia (IT)

(72) Inventors: Roberto Trilli, Serre di Rapolano (IT); Marco Anichini, Siena (IT)

(73) Assignee: I.M.A. INDUSTRIA MACCHINE AUTOMATICHE S.P.A IN SIGLA IMA S.P.A., Ozzano Dell'Emilia (IT)

( * ) Notice: Subject to any disclaimer, the term of this patent is extended or adjusted under 35 U.S.C. 154(b) by 287 days.

(21) Appl. No.: 15/579,865

(22) PCT Filed: Jun. 7, 2016

(86) PCT No.: PCT/EP2016/062880
§ 371 (c)(1),
(2) Date: Dec. 5, 2017

(87) PCT Pub. No.: WO2016/198391
PCT Pub. Date: Dec. 15, 2016

(65) Prior Publication Data

US 2018/0162572 A1 Jun. 14, 2018

(30) Foreign Application Priority Data

Jun. 11, 2015 (IT) ..... 102015000022600

(51) Int. Cl.
*B65B 31/02* (2006.01)
*B65B 55/02* (2006.01)
(Continued)

(52) U.S. Cl.
CPC ..... *B65B 31/027* (2013.01); *B65B 1/46* (2013.01); *B65B 3/003* (2013.01); *B65B 7/161* (2013.01);
(Continued)

(58) Field of Classification Search
CPC ..... B65B 31/027; B65B 31/025; B65B 31/02; B65B 1/46; B65B 3/003; B65B 7/161;
(Continued)

(56) References Cited

U.S. PATENT DOCUMENTS 6,151,535 A * 11/2000 Ehlers ..... G01N 35/04 198/340
6,164,044 A * 12/2000 Porfano ..... B65B 55/10 422/28
(Continued)

FOREIGN PATENT DOCUMENTS

CN 1966390 A 5/2007
CN 102574123 A 7/2012
(Continued)

OTHER PUBLICATIONS

International Search Report dated Sep. 16, 2016 re: Application No. PCT/EP2016/062880; pp. 1-3; citing: US 2012/090268 A1 and WO 2015/023924 A2.
(Continued)

*Primary Examiner* — Dariush Seif
(74) *Attorney, Agent, or Firm* — Cantor Colburn LLP

(57) ABSTRACT

A method for filling and sealing containers such as bottles, cartridges, syringes and the like, wherein the containers are accommodated individually within respective seats of a first nest which in turn is contained in a first transport tub. The method includes the step of supplying the containers; extracting at least one individual container at a time from the first nest and transferring it to a filling station in order to fill
(Continued)

the at least one container with a substance; transferring the at least one filled container to a crimp capping station, passing through a separating partition; crimp capping the at least one container at the crimp capping station; and inserting the at least one crimp capped-container in a respective seat of a second nest.

13 Claims, 7 Drawing Sheets

(51) Int. Cl.
*B65B 1/46* (2006.01)
*B65B 3/00* (2006.01)
*B65B 7/16* (2006.01)

(52) U.S. Cl.
CPC ..... *B65B 7/168* (2013.01); *B65B 31/025* (2013.01); *B65B 55/027* (2013.01)

(58) Field of Classification Search
CPC ..... B65B 7/168; B65B 7/285; B65B 55/027; B65B 5/068
USPC ..... 53/432, 471, 485, 488, 489, 510, 511, 53/545, 562, 281
See application file for complete search history.

(56) References Cited

U.S. PATENT DOCUMENTS 6,832,463 B2 * 12/2004 Grifols Lucas ..... A61L 2/07 53/167
8,601,777 B2 * 12/2013 Monti ..... B65B 3/003 53/173
8,978,344 B2 * 3/2015 Krauss ..... B65B 3/003 53/281
2003/0056466 A1 3/2003 Muneyasu
2004/0139698 A1 * 7/2004 Grifols Lucas ..... A61L 2/07 53/426
2005/0188651 A1 * 9/2005 Clusserath ..... B67C 7/002 53/136.1
2005/0223677 A1 * 10/2005 Py ..... B65B 3/003 53/140
2006/0136095 A1 6/2006 Rob et al.
2008/0184671 A1 * 8/2008 Fleckenstein ..... B65B 3/003 53/268
2010/0064631 A1 * 3/2010 Krauss ..... B65B 7/2807 53/167
2011/0094189 A1 * 4/2011 Bottger ..... B65B 7/2821 53/425
2011/0158850 A1 * 6/2011 Pedrazzini ..... B01L 9/02 422/65
2012/0090268 A1 * 4/2012 Krauss ..... B65B 3/003 53/281
2013/0067867 A1 * 3/2013 Veile ..... B65B 43/42 53/471
2014/0034545 A1 * 2/2014 Pawlowski ..... B65D 25/101 206/565
2014/0093335 A1 * 4/2014 Chiang ..... B65G 49/00 414/222.01
2018/0016039 A1 * 1/2018 Veile ..... B65B 43/42
2018/0126066 A1 * 5/2018 Narvekar ..... B65B 39/00
2018/0339796 A1 * 11/2018 Bai ..... B25J 15/0616

FOREIGN PATENT DOCUMENTS

CN 104272049 A 1/2015
CN 104411353 A 3/2015
DE 10345338 A1 4/2005
DE 102004005342 A1 9/2005
DE 102008001287 A1 10/2009
DE 102009041215 A1 3/2011
DE 102011113358 A1 3/2013
EP 3307629 A1 4/2018
FR 2860978 A1 4/2005
JP 2008247413 A 10/2008
WO 2015023924 A2 2/2015
WO 2016198391 A1 12/2016

OTHER PUBLICATIONS

Written Opinion dated Sep. 16, 2016 re: Application No. PCT/EP2016/062880; pp. 1-6; citing: US 2012/090268 A1 and WO 2015/023924 A2.
JP Office Action dated May 12, 2020 re: Application No. 2017-563322, pp. 1-19, citing: US 2013/0067867, JP 2008-274413 A and US 2012/0090268.

* cited by examiner

METHOD AND MACHINE FOR FILLING AND SEALING BOTTLES, CARTRIDGES, SYRINGES AND THE LIKE

TECHNICAL FIELD

The present disclosure relates to a method for filling and sealing bottles, cartridges, syringes and the like, and a machine adapted to apply such method.

BACKGROUND

In the pharmaceutical sector, products and substances that take liquid and/or powdered form can be efficaciously packaged in dedicated containers, which are often adapted to contain a single dose, so as to facilitate the operations of administration thereof to the patient.

Such products and substances are therefore packaged in specific bottles, phials, cartridges (such as for example the carpules used in syringes for administering local anesthetics), syringes (such as the ready-to-use syringes used for many and varied applications) and the like.

The conventional methods for filling containers such as bottles, cartridges, syringes and the like involve providing tubs that accommodate adapted nests within which the individual containers are arranged in an orderly fashion.

The tubs, the nests and the containers are of standard type, produced by corresponding suppliers who are usually different from the suppliers who fill them, and constitute the largest dimensional and structural constraint to which a method of filling and closing needs to conform, as well as a machine for carrying out such operations.

The conventional processes involve picking up the nest, in which a plurality of empty and sterile containers is stored, from the corresponding tub and transferring it to an operating area from where at least one individual container at a time is picked up, filled with the specific substances desired, and the opening thereof is closed in order to isolate the contents from the external environment.

It is necessary that such operations be performed in a sterile environment (in order to prevent the pharmaceutical substances, the active ingredients and the like from being contaminated): however, some steps of the method involve processes that can generate dust and/or volatile substances, which can lead to contamination of the containers, which are still empty, in the nest.

In relation to the necessary sterility of the environment in which the pharmaceutical substances are packaged, the possible deposit of these contaminants on the containers is a major problem, which becomes more acute for pharmaceutical substances that are particularly reactive and/or unstable, for which any contact with contaminants of any type or nature must be avoided at all costs.

It follows from this that the industrial processes of filling and closing containers such as bottles, cartridges, syringes and the like are for the most part subject to risks of contamination of such containers, before the introduction therein of the pharmaceutical substance is begun, owing to processing residues generated during the process of closing one of the containers that was earlier filled and closed.

In particular, one of the closure operations of a individual container is the arrangement of a metallic crimp cap on the neck of the container, which locks a closure stopper (usually made of polymeric or elastomeric material and the like) that was previously inserted into the mouth of the container (through which the pharmaceutical substance had earlier been introduced).

The metallic crimp cap is subjected to plastic deformations, after its juxtaposition against the top of the container, in order to render it integral with an end lip of the neck of the container.

Such plastic deformations, which are carried out by specific utensils, can determine the formation of dust which, swirling around inside the machine for filling and closing, could be deposited on (and therefore could contaminate) the containers present in the nest, for example while waiting to be filled, while waiting to be plugged and/or while waiting to be crimp capped.

SUMMARY

The aim of the present disclosure is to solve the above mentioned drawbacks, by providing a method for filling and sealing bottles, cartridges, syringes and the like which prevents the contamination of containers of the type of bottles, cartridges, syringes and the like with suspended dust and/or volatile substances generated during the closing steps.

Within this aim, the disclosure devises a method for filling and sealing bottles, cartridges, syringes and the like which ensures a high standard of quality of the phials, bottles, cartridges, syringes and the like, filled and closed, which are obtained by applying such method.

The disclosure devises a machine for filling and sealing bottles, cartridges, syringes and the like which is adapted to prevent the contamination of the containers of the type of bottles, cartridges, syringes and the like with suspended dust and/or volatile substances generated during the closing steps by the devices for closing them.

The disclosure further devises a machine for filling and sealing bottles, cartridges, syringes and the like which is particularly versatile, and therefore adapted to work interchangeably on bottles, cartridges, syringes and the like, by introducing a specific quantity of pharmaceutical substance and adopting the most suitable type of closure for each specific case.

The disclosure also devises a machine for filling and sealing bottles, cartridges, syringes and the like which is similar, even partially, to conventional ones, by adopting an alternative technical and structural architecture to that of conventional packaging machines.

The present disclosure provides a method and a machine for filling and sealing bottles, cartridges, syringes and the like which is low cost, easily and practically implemented, and safe in use.

This aim and these and other advantages are achieved by providing a method for filling and sealing bottles, cartridges, syringes and the like, wherein said bottles, cartridges, syringes and the like, generally termed containers, said containers being accommodated individually within respective seats of a first nest which in turn is contained in a first transport tub, which includes the following steps:

- supplying said containers which are accommodated individually within respective seats of said first nest which in turn is associated with said first transport tub,
- extracting at least one individual container at a time from the first nest and transferring it to a filling station in order to fill said at least one container with a substance;
- transferring said at least one filled container to a crimp capping station, passing through a separating partition;
- crimp capping said at least one container at said crimp capping station; and
- inserting said at least one crimp capped container in a respective seat of a second nest.

These advantages are also achieved by providing a machine for filling and sealing bottles, cartridges, syringes and the like, generally termed containers, said containers being accommodated individually within respective seats of a first nest which in turn is contained in a first transport tub, characterized in that it comprises a filling station and a crimp capping station, between which a separating partition is interposed, said filling station comprising a first selective handling unit designed to extract at least one individual container at a time from said first nest, align it with a dispenser for filling it, and juxtapose it against a transfer device in said crimp capping station, said crimp capping station comprising, beyond said partition, a second selective handling unit for picking up said at least one container from said transfer device, aligning the container with a crimp capping unit for coupling a crimp cap to the top of said container, and delivering the crimp capped container to a seat of a second nest.

In a preferred embodiment the container is aligned with a crimp cap distributor in order to juxtapose a crimp cap against the top of said container, supplying the container surmounted by a respective crimp cap to a presser for deforming the crimp cap to shape-mate with the portion of container on which it is arranged and delivering the crimp capped product to a seat of a second nest.

BRIEF DESCRIPTION OF THE DRAWINGS

Further characteristics and advantages of the disclosure will become better apparent from the detailed description of a preferred, but not exclusive, embodiment of the machine for filling and sealing bottles, cartridges, syringes and the like according to the disclosure, which is illustrated by way of non-limiting example in the accompanying drawings, wherein.

DETAILED DESCRIPTION OF THE DRAWINGS

Figure 1:
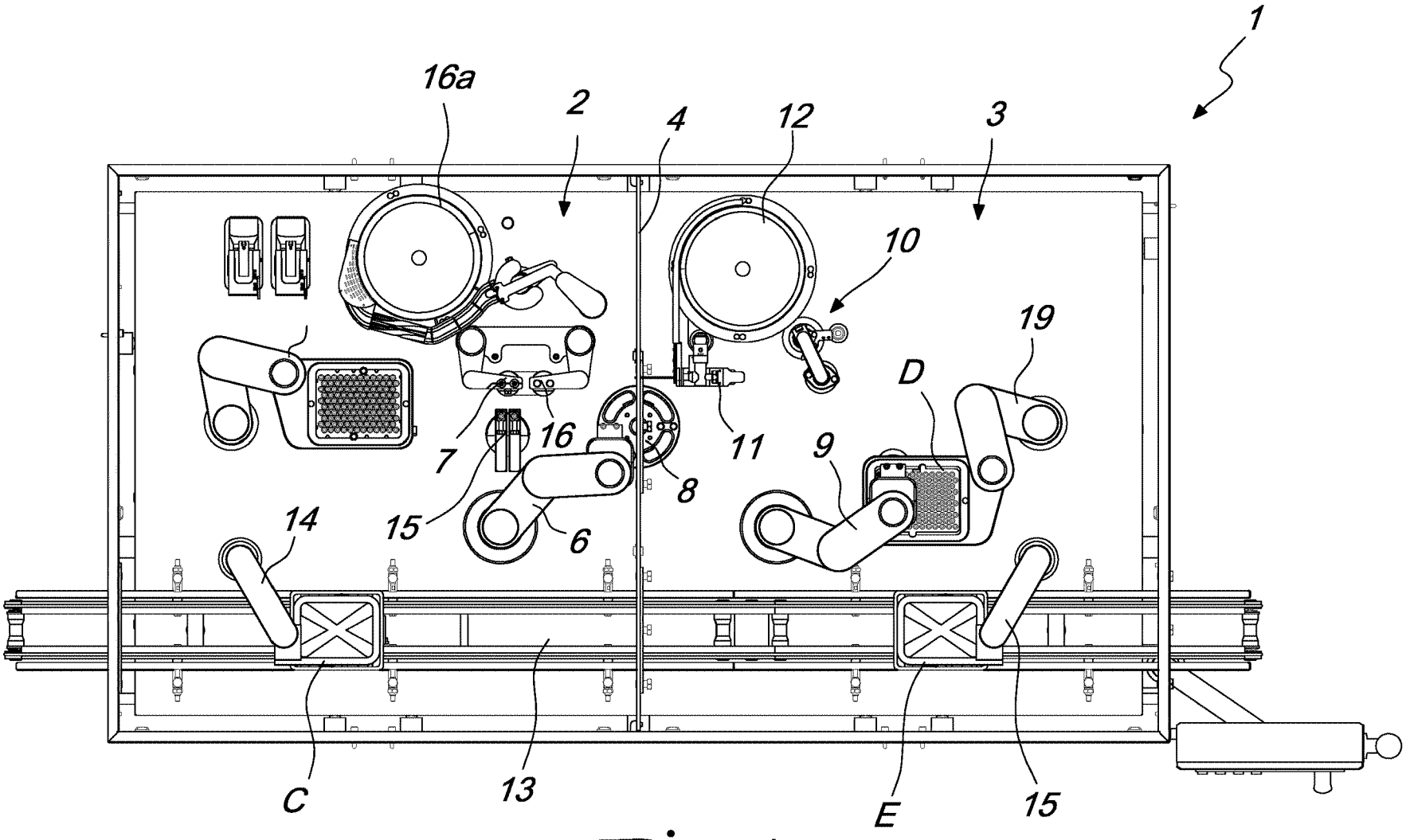
FIG. 1 is a view from above of a possible embodiment of a machine for filling and sealing bottles, cartridges, syringes and the like, according to the disclosure.
Figure 2:
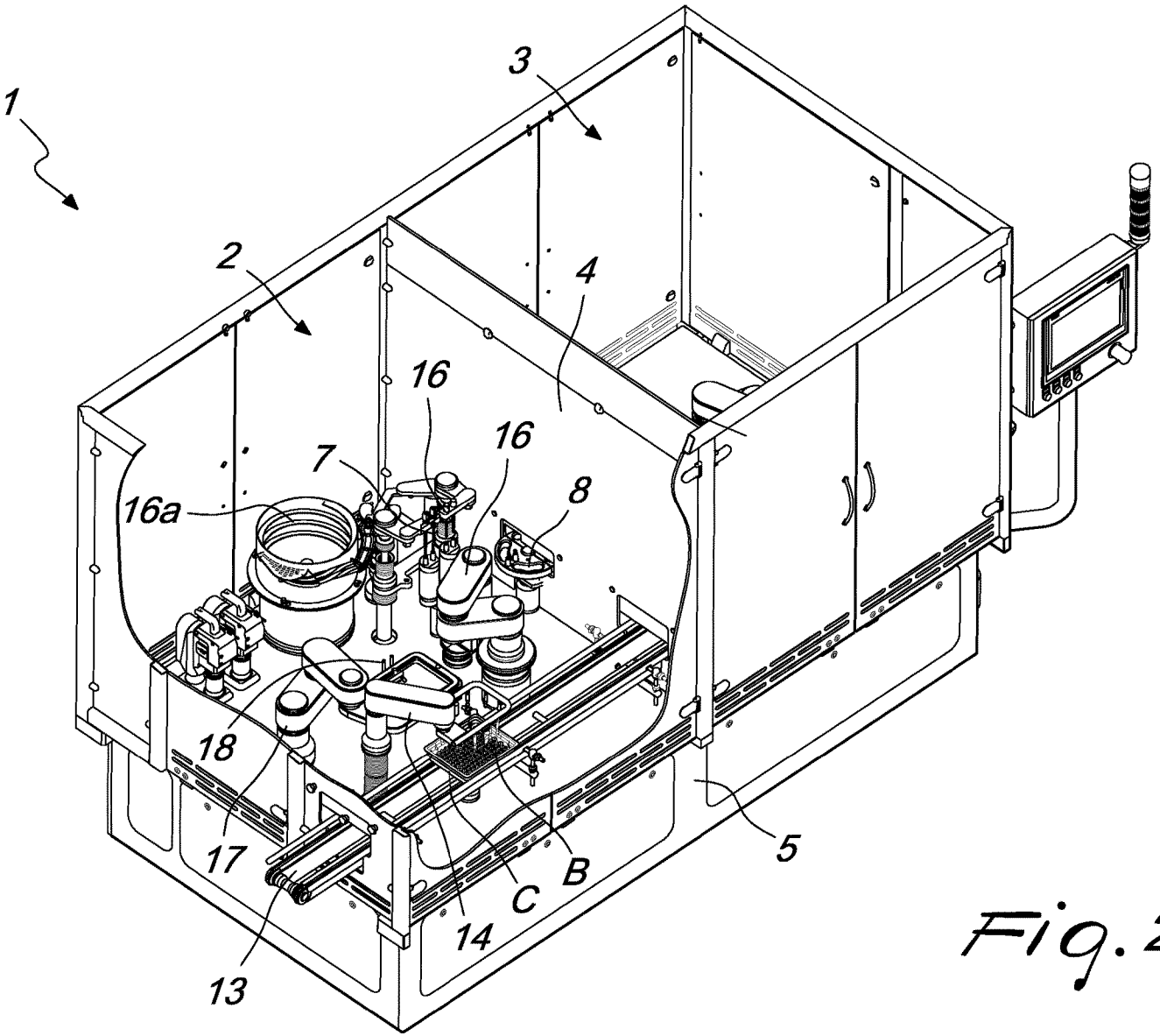
FIG. 2 is a partially cutaway perspective view from the front of a first portion of the machine in FIG. 1.
Figure 3:
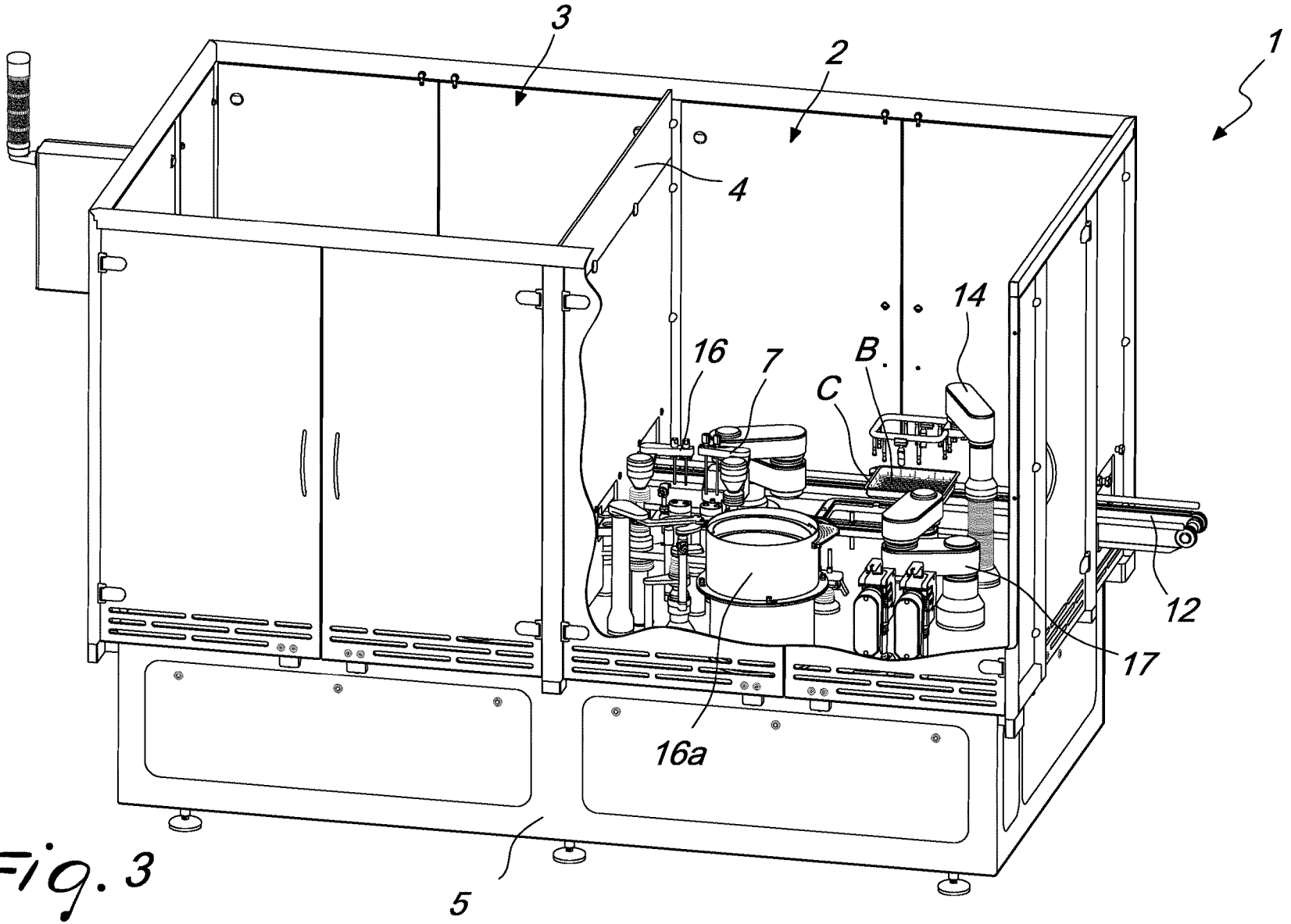
FIG. 3 is a partially cutaway perspective view from the rear of a first portion of the machine in FIG. 1.
Figure 4:
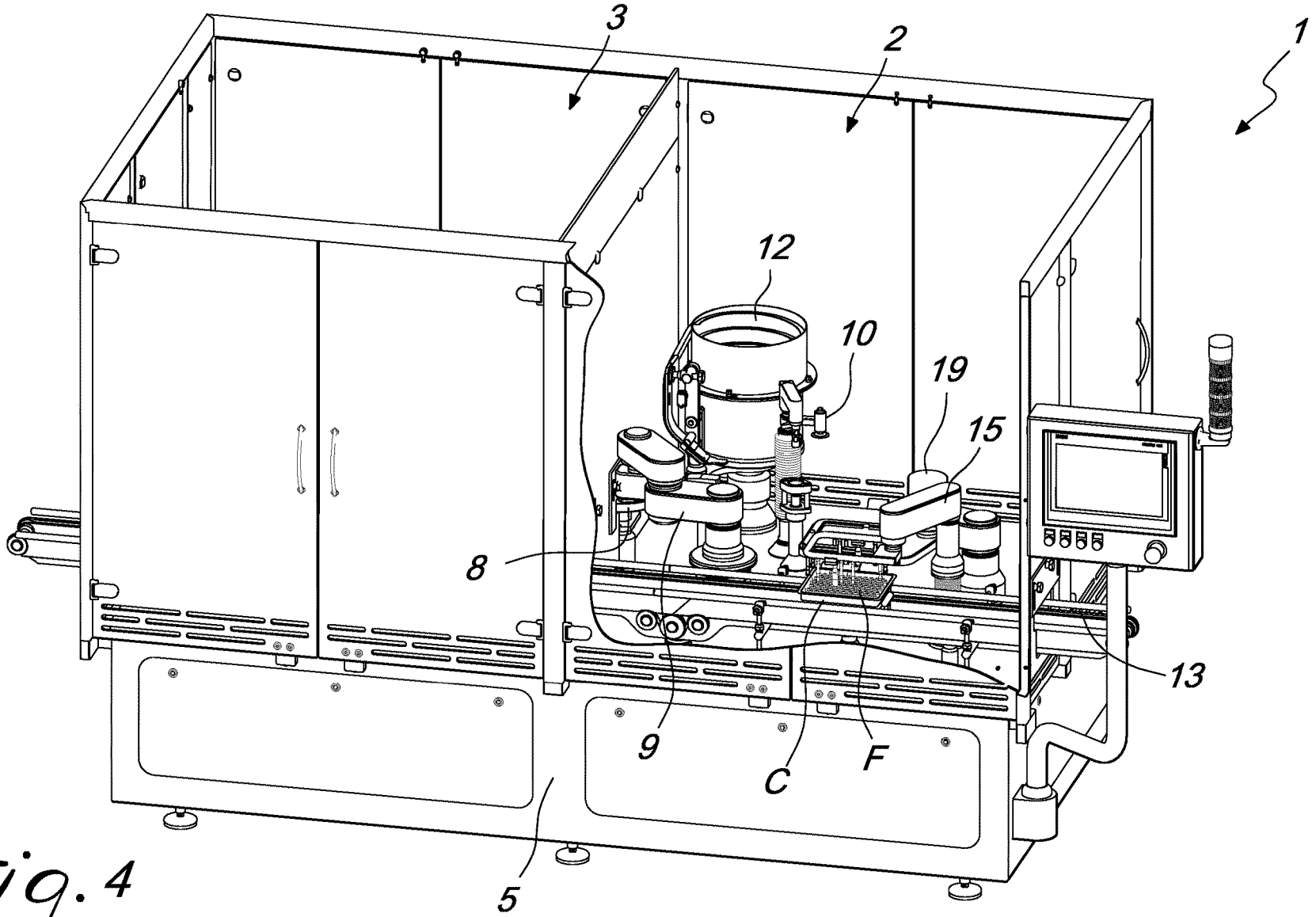
FIG. 4 is a partially cutaway perspective view from the front of a second portion of the machine in FIG. 1.
Figure 5:
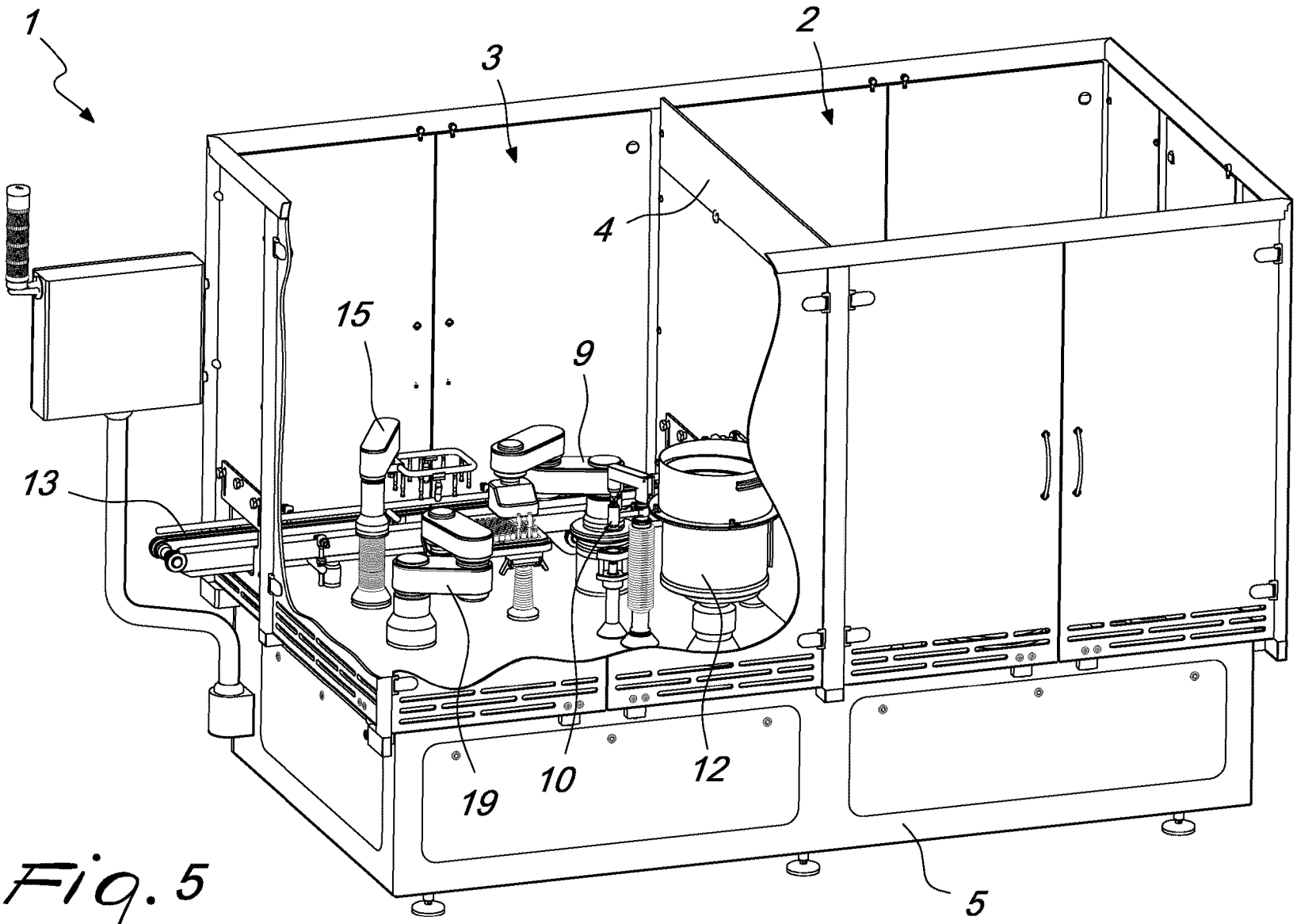
FIG. 5 is a partially cutaway perspective view from the rear of a second portion of the machine in FIG. 1.
Figure 6:
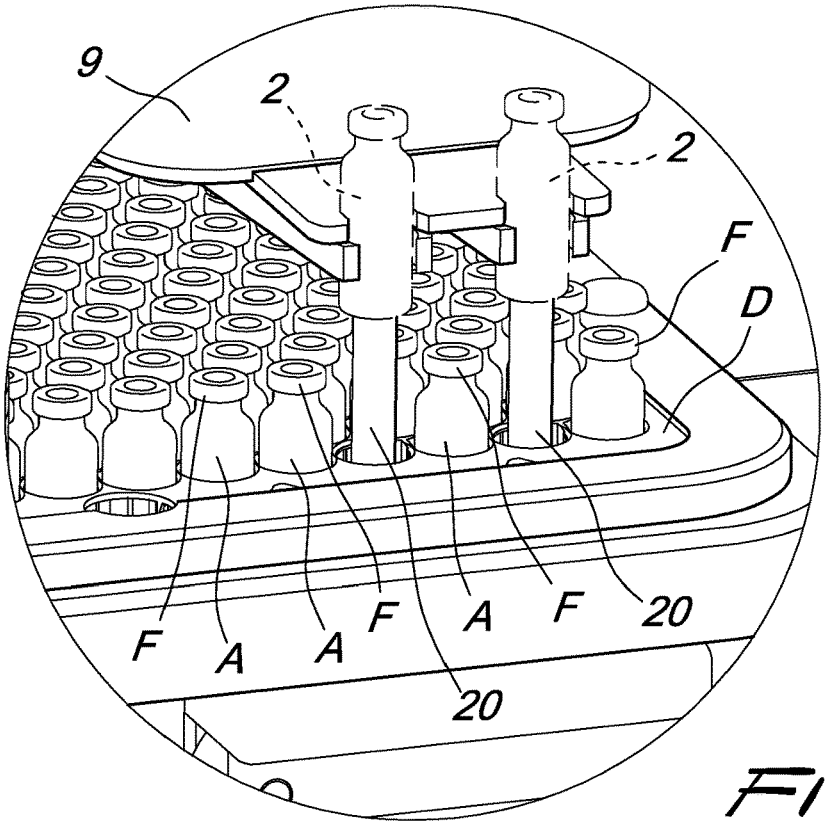
FIG. 6 is a perspective view of an enlarged detail of a first portion of the machine in FIG. 1 in the step of delivering the crimp-capped containers to a second nest.
Figure 7:
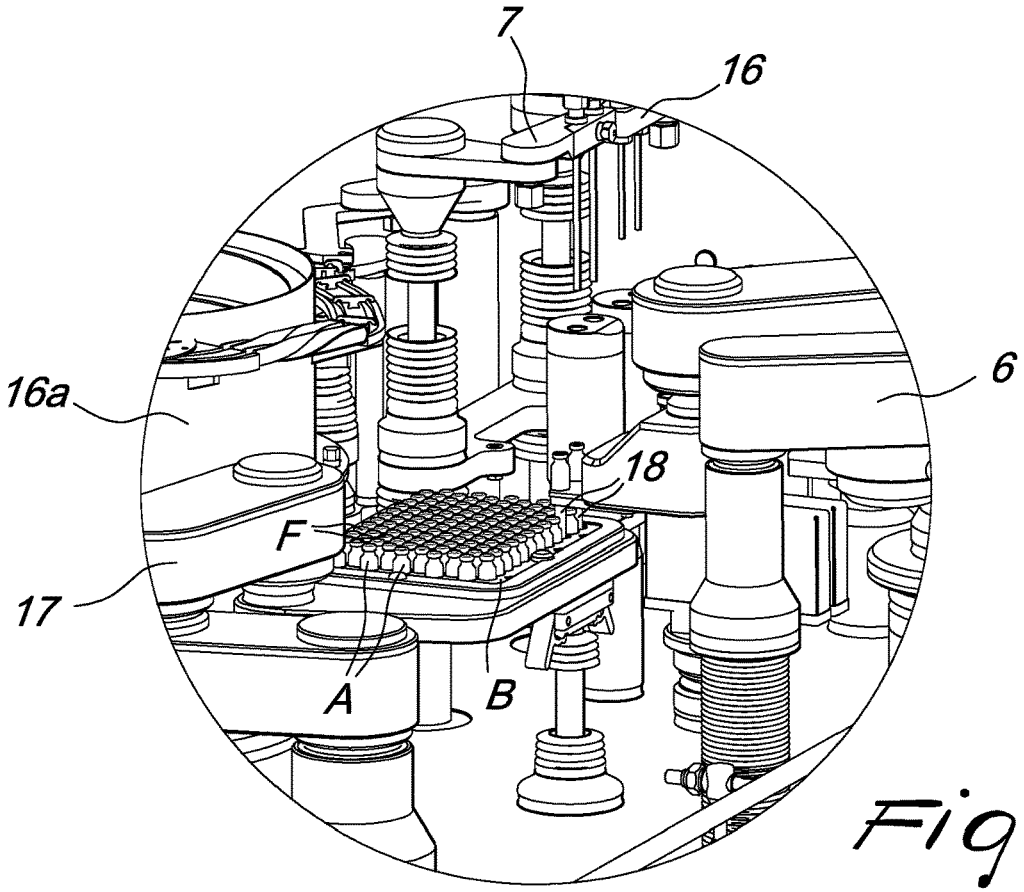
FIG. 7 is a perspective view of an enlarged detail of a second portion of the machine in FIG. 1 in the step of picking up the empty containers from a first nest.
Figure 8:
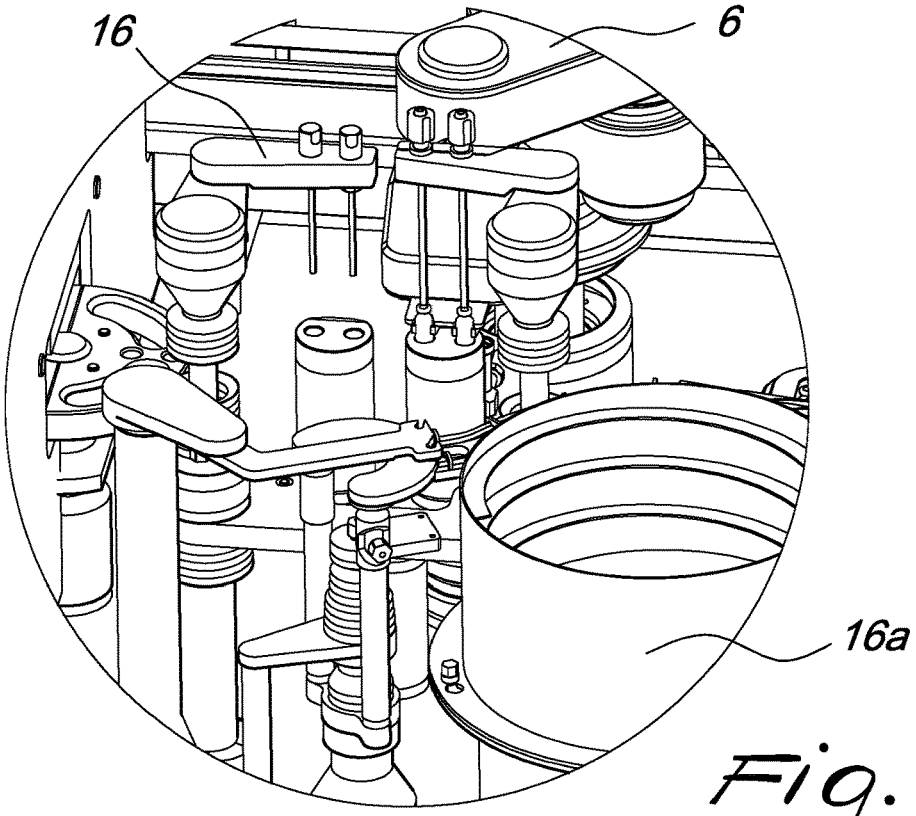
FIG. 8 is a perspective view of an enlarged detail of a third portion of the machine in FIG. 1 in the step of filling the empty containers.
Figure 9:
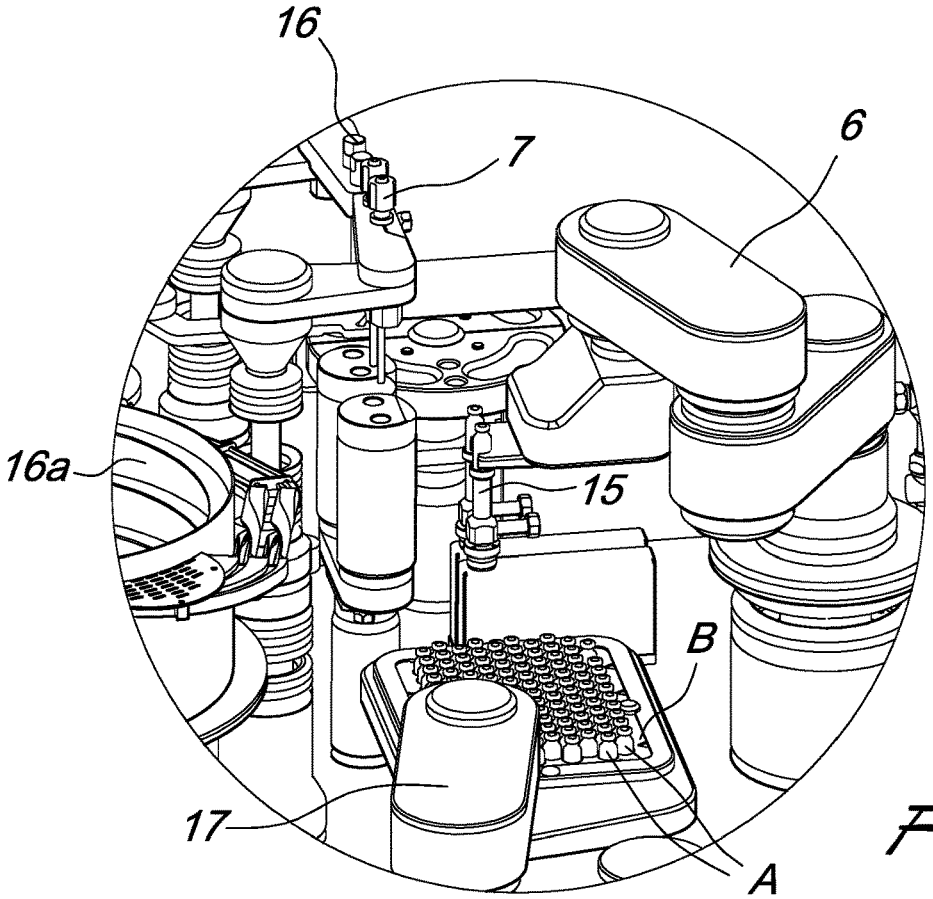
FIG. 9 is a perspective view of an enlarged detail of a fourth portion of the machine in FIG. 1 in the step of weighing the containers.

With reference to FIGS. 1-9, the reference numeral 1 generally designates a machine for filling and sealing bottles, cartridges, syringes and the like, which are generally termed containers A.

The method according to the disclosure is adapted to fill and seal containers A (which, as indicated previously, can be interchangeably bottles, cartridges, syringes and the like) which are accommodated individually within respective seats of a first nest B which in turn is contained in a first transport tub C.

Firstly it is necessary to supply the containers A (which will be empty and sterile) which are accommodated individually in the respective seats of the first nest B.

Then comes the extraction of at least one individual container A at a time from the first nest B and its transfer to a filling station 2 in order to fill such at least one container A with a substance.

The filling substance can be any, usually in liquid or powder form, and the quantity of substance introduced can be regulated according to the specific requirements and the capacity of the container A being processed.

Then comes a step of transferring the at least one filled container A to a crimp capping station 3, passing through a separating partition 4.

Once it has reached the crimp capping station 3 it will be possible to crimp cap the container A at that station 3.

The container A fitted with the crimp cap F which is conveniently locked onto the neck of the container so as to define a closing seal, can then be inserted in a respective seat of a second nest D.

In order to verify the exact weight of the empty container A (in order to carry out successive checks on the correct filling), after having extracted it from the first nest B and before filling it, each container A is weighed when it is empty.

In order to verify that the right quantity of filling substance is introduced into the container A it is further necessary to weigh the at least one individual container A after filling it: a management and control unit will be able to determine the weight of the introduced substance (from the difference between the weight of the full container A and the weight of the same container A when empty) and verify its correspondence to the preset standards. If an incorrect quantity of the introduced substance is found, it will be possible to identify the specific container A in order to discard it or subject it to intervention by an operator.

In order to prevent the introduced substance in the container A from being contaminated through contact with dust and/or the like (for example present in suspension in the air) it is advisable, immediately after each container A has been filled, to juxtapose a closure stopper (actually this is a protective stopper that, although not coupled stably to the corresponding container A and therefore not adapted to completely close it, is placed as barrier against any contaminants that may be present in the working environment) against the opening of the at least one container A. In this manner any exchange is avoided between the external environment and the inside of the container A, in which the introduced substance is present.

Moreover, the placing of a stopper is extremely advantageous because of the fact that some substances (in use in the pharmaceutical, chemical and biotechnological sectors) are highly volatile and therefore the presence of the stopper ensures that they are not dispersed into the environment before the sealing.

For the purpose of preventing the entry of dust or other contaminants into the filling station 2, a higher pressure is established in the filling station 2, which is located upstream of the separating partition 4, with respect to the crimp capping station 3, which is located downstream of the separating partition 4 (with respect to the direction of advancement of the containers A inside the machine 1).

This condition can be ensured by using a conveyed air circuit which is already present in the installation area of the machine 1, or by providing specific compressors or other, similar devices adapted to achieving this end.

The machine 1 for filling and sealing containers A will therefore comprise a filling station 2 and a crimp capping station 3 between which the aforementioned separating partition 4 is interposed.

Both stations 2 and 3 and the partition 4 will be supported by a conventional frame 5 placed on the ground and connected to respective power supply circuits (for example there will be a connection to the mains electricity supply and, optionally, there will be a connection to at least one data network and to a circuit for supplying conveyed/compressed air).

The filling station 2, according to the disclosure, comprises, mainly, a first selective handling unit 6 which is designed to extract at least one individual container A at a time from the first nest B.

Once the container A has been extracted, the first selective handling unit 6 will align it with a dispenser 7 for filling the container A with the desired substance.

The dispenser 7 will comprise at least one nozzle which can be inserted (at least partially) into the container A, in order to release the substance.

The dispenser 7 will preferably comprise an internal dosage measurer which is designed to control the quantity of substance introduced into the container A at each dispensing: the dosage measurer will be programmable so as to define in each instance the appropriate quantity of substance as a function of the capacity of the containers A with which to work and according to the specific packaging requirements of the particular pharmaceutical, chemical and/or biological/biotechnological substance.

The first selective handling unit 6 will then therefore provide to juxtapose the container A against a transfer device 8 in the crimp capping station 3, beyond the partition 4.

The crimp capping station 3, according to the disclosure, comprises, mainly, a second selective handling unit 9 for picking up the at least one container A from the transfer device 8 and aligning it with a crimp capping unit 10 in order to juxtapose and fix a crimp cap F against the top of the container A.

Upstream of the crimp capping unit 10 there is preferably a distributor 11 of crimp caps F which deposits a crimp cap F on the top of each container A, so that the containers A arrive at the crimp capping unit 10 already topped by a respective crimp cap F, thus speeding up the sealing of the container A with such crimp cap F.

The distributor 11 can preferably be of the "break-off" type in which the container A passes below a region of the distributor 11, brushing against a crimp cap F protruding from that region and picking it up during such passage.

The crimp caps F arrive conveniently aligned with the distributor 11 by way of an automatic vibrating orientator 12 of the type comprising a substantially cylindrical collector drum on the side walls of which there is a track for the ordered conveyance of the crimp caps F.

The second selective handling unit 9 lastly delivers the crimp capped container A in a seat of a second nest D.

It should be noted that the first selective handling unit 6 and the second selective handling unit 9 can advantageously be constituted by anthropomorphic robots, articulated arms and/or multi-axis movers, of substantially known type.

According to a particular embodiment of undoubted practical and applicative interest, the machine 1 comprises, further, a conveyor belt 13 for the transport tubs C and E, which contain the nests B and D.

The conveyor belt 13 affects the entire machine 1, defining a path along one side thereof for the tubs C and E: the tubs C and E, along the line 13, can move from a position of alignment with a first grip element 14, which is designed to transfer the first nest B from the respective tub C arranged on the conveyor belt 13 to the first selective handling unit 6, to a second position of alignment with a second grip element 14 for the transfer of the second nest D from the second selective handling unit 9 to the conveyor belt 13.

The conveyor belt 13 can be simply constituted by a conveyor belt on which the tubs C and E are resting, in such case there will be moveable appendages for stopping the tubs C and E in preset positions; alternatively, the possibility exists of providing the belt 13 by way of conveyor chains provided with "drawers" (in general, with dedicated receptacles) through which to control the position of each tub C and E instant by instant.

The machine 1, in order to prevent the entry into the filling station 2 of contaminants (from the external environment and/or from the crimp capping station 3), comprises, in the first filling station 2, pneumatic elements for injecting gas (conveyed air) in order to maintain, inside the station 2, a pressure higher than the ambient pressure and than the pressure present in the crimp capping station 3.

In this manner the circulation of gas (air) can occur only from the inside of the filling station 2 outwardly, thus preventing the reverse direction of circulation which could permit the entry of contaminants.

The presence of the separating partition 4 and the establishment of an overpressure inside the filling station 2 ensure that the substance introduced into the containers A cannot be subjected to contamination, in conformance with the requirements of the pharmaceutical, chemical and biological/biotechnological industries.

In particular, in the pharmaceutical sector regulations require measures to be taken which are aimed at minimizing contamination. Conventional machines, in fact, adopt technical solutions that reduce the risk of contamination, but none of these is capable of rendering it almost negligible, as can be achieved with the machine 1 according to the disclosure.

The isolation of the environments defined inside the filling station 2 and the crimp capping station 3, which is obtained by way of the partition 4, is safeguarded thanks to the presence of a transfer device 8 which comprises a rotating carousel affected by the partition 4 substantially at its centerline.

The carousel is provided with respective substantially perimetric seats for the temporary accommodation of the containers A.

A rotation of the carousel is therefore adapted to transfer the containers A that are in the seats arranged in the filling station 2 beyond the partition 4, to the crimp capping station 3.

According to a possible embodiment that involves the adoption of optional components (which can contribute to a better operation of the machine 1 according to the disclosure but which are not essential for that operation) the carousel and the partition 4 will be shaped so as to have dividers, either fixed or moveable (usually closed): moveable dividers can temporarily open, allowing the passage through of the containers A.

In the short period for which the moveable dividers will be open, the overpressure present in the filling station 2 will ensure that the flow of air that will be established through the open gaps will be directed from the filling station 2 to the crimp capping station 3, thus preventing reverse-direction flows that could result in the entry of contaminants into the filling station 2.

For fixed dividers, the slit left open by them will allow the limited passage of air: such limitation, combined with the presence of the overpressure in the filling station 2, will prevent the entry of contaminants into the station 2 (the speed of the flow of air that passes through the slits to flow into the crimp capping station 3 will be such as to prevent any contaminants from being able to ascend against the current).

In order to have an exact verification of the quantity of substance introduced into each container A, the filling station 2 comprises at least one load cell 15 for detecting the weight of the container A in either the configuration of empty container A, before introducing the filling substance, or the configuration of full container A, after introducing the filling substance, or both configurations.

The load cell 15 is arranged along the path of the first selective handling unit 6, between the region for extracting at least one individual container A at a time from the first nest B and the at least one filling dispenser 7.

Preferably the load cell 15 will carry out a weighing of the empty container A, before this is aligned with the dispenser 7 for introducing the filling substance, in order to determine the weight of the container A (tare weight) on which the machine 1 is operating at that moment.

After the container A has been filled, it will be sent to the load cell 15 again for its weighing, thus detecting the overall weight, constituted by the sum of the weight of the container A alone and the weight of the filling substance introduced into it.

In this manner, by way of a processor adapted to process the data from the readings of the load cell 15, it will be possible to detect with precision the quantity of substance introduced into each container A, so controlling any filling errors and/or overruns with respect to the tolerances envisaged. The processor will be capable of keeping track of the container A that may contain an incorrect quantity of substance in order to eliminate it (subsequently, outside the machine 1) from the production batch.

As already amply shown previously, the machine 1 achieves the aim of preventing the contamination of the substance introduced into the containers A and/or the contamination of the containers A (when they are still empty and accommodated in the first nest B).

In order to prevent the contamination of the substance present inside the containers A, it should be noted that the machine 1 further comprises, downstream of the dispenser 7 (for filling) and upstream of the transfer device 8, an automatic stopper fitting machine 16 for applying a stopper in the opening of at least one container A, thus isolating its contents from the external environment.

This embodiment makes it possible to provide the transfer device 8 only with stoppered containers A: these therefore will arrive at the crimp capping station 3 (passing through the partition 4) stoppered, a condition that reduces to the minimum the possibility of contamination through dust in suspension (while noting that the containers A will be considered stably closed only after the crimp cap F has been deposited).

This is particularly relevant if we consider that the crimp capping unit 10 makes plastic deformations in the crimp caps F and therefore it certainly generates a certain quantity of dust, against which it is necessary to protect contents of each container A.

The stoppers will be supplied to the automatic stopper fitting machine 16 in a configuration of orderly mutual alignment by an orientator **16*a* which is entirely similar to the automatic vibrating orientator 12** operating on the crimp caps F which was described previously.

It should conveniently be noted that the first selective handling unit 6 is functionally associated with a first structure 17, for supporting the first nest B.

The structure 17 will preferably be able to move on a horizontal plane.

Below the latter there will be at least one first pusher 18 for lifting at least one container A at a time from the first nest B and delivering it to the first selective handling unit 6.

In particular the movable structure 17 will shift the nest B (while keeping it horizontal), progressively causing the alignment of at least one container A with the at least one first pusher 18.

Once alignment is achieved, the pusher 18 will lift, translating the respective container A upwardly and enabling the first selective handling unit 6 to grasp it.

In order to prevent misalignments of the containers A lifted by the first pusher 18, there is a sucker on the top of the pusher 18, which is adapted to retain the container A, preserving its vertical orientation (the alignment in general).

Similarly, the second selective handling unit 9 is functionally associated with a second structure 19, for supporting the second nest D.

The second structure 19 will also be moveable on a horizontal plane, and it also will surmount at least one second pusher 20 which is designed to receive at least one container A at a time from the second selective handling unit 9 and to deposit it in a respective seat of the second nest D.

As illustrated previously for what happens in the filling station 2, in the crimp capping station 3 the movable structure 19 will shift the nest D (while keeping it horizontal), progressively causing the alignment of at least one container A with the at least one second pusher 20.

Once the alignment is achieved, the pusher 20 will lift by translating upwardly in order to retrieve the at least one container A held by the second selective handling unit 9.

In order to prevent misalignments of the containers A retrieved by the second pusher 20, there is a sucker on the top of the pusher 20, which is adapted to retain the container A, preserving its vertical orientation (the alignment in general).

Effectively the present disclosure solves the above mentioned problems, by providing a method for filling and sealing bottles, cartridges, syringes and the like which is capable of preventing the contamination of processed containers A of the type of bottles, cartridges, syringes and the like with suspended dust and/or volatile substances generated during the closing steps.

In particular the containers A will not be subjected to the dust generated by the crimp capping unit 10 which, by making plastic deformations on the metallic material that constitutes the crimp caps F, can put such dust contaminants in suspension in the air present within the crimp capping station 3. As has been seen, the containers A will reach the crimp capping station 3 after having been subjected to stoppering and therefore their contents will be protected, from contaminants present in the air, when they are in the crimp capping station 3. By contrast, when the containers A (still empty or full but without stopper) are located in the filling station 2, they cannot be contaminated because the separating partition 4 and the presence of an overpressure prevent the entry of contaminants into the filling station 2.

Advantageously, the method according to the disclosure ensures a high qualitative standard of the phials, bottles, cartridges, syringes and the like, filled and closed, that are obtained by the application thereof.

In fact, although the method according to the disclosure provides a way to prevent any possible contamination of the containers A and of their contents, it ensures the execution of all the operations envisaged by the most advanced and rigorous conventional methods, thus obtaining a sealed container A that conforms to the highest qualitative standards, the content of which is free from contamination.

Conveniently, the machine 1 for filling and sealing bottles, cartridges, syringes and the like is adapted to prevent the contamination of the containers A that are processed by it with suspended dust and/or volatile substances generated by the devices for closing them.

Positively the machine 1 according to the disclosure is particularly versatile, and therefore adapted to work interchangeably on bottles, cartridges, syringes and the like, by introducing a specific quantity of pharmaceutical (and/or chemical and/or biological, etc.) substance and adopting the most suitable type of closure for each specific case.

Conveniently the machine 1 according to the disclosure, although partially similar to those of the conventional type, adopts an alternative technical and structural architecture to that of conventional packaging machines.

Advantageously, the method and the machine 1 for filling and sealing bottles, cartridges, syringes and the like can be implemented at low cost, being relatively simple to execute and practical and safe in use.

The disclosure, thus conceived, is susceptible of numerous modifications and variations. Moreover, all the details may be substituted by other, technically equivalent elements.

In the embodiments illustrated, individual characteristics shown in relation to specific examples may in reality be interchanged with other, different characteristics, existing in other embodiments.

The disclosures in Italian Patent Application No. 102015000022600 (UB2015A001052) from which this application claims priority are incorporated herein by reference.

The invention claimed is:

1. A method for filling and sealing containers, wherein said containers are accommodated individually within respective seats of a first nest which in turn is contained in a first transport tub, the method comprising the steps of:

supplying said containers which are accommodated individually within respective seats of said first nest which in turn is associated with said first transport tub;

extracting at least one individual container at a time from the first nest with a first selective handling unit of a filling station and transferring it to said filling station in order to fill said at least one container with a substance;

transferring said at least one filled container to a crimp capping station having a second selective handling unit, passing through a separating partition;

crimp capping said at least one container at said crimp capping station;

inserting said at least one crimp capped container in a respective seat of a second nest using said second selective handling unit.

2. The method according to claim 1, further comprising the steps of:

weighing, after the extraction of the at least one individual container from the first nest and before its filling, said at least one container.

3. The method according to claim 1, further comprising the steps of:

weighing, after the filling of the at least one individual container, said at least one container.

4. The method according to claim 1, further comprising the steps of:

juxtaposing, before the transfer of said at least one filled container to a crimp capping station, passing through a separating partition, a closure stopper against an opening of said at least one container.

5. The method according to claim 1, further comprising the steps of:

establishing a higher pressure in said filling station, arranged upstream of said separating partition, with respect to the crimp capping station, arranged downstream of said separating partition.

6. A machine for filling and sealing containers, said containers being accommodated individually within respective seats of a first nest which in turn is contained in a first transport tub, the machine further comprising a filling station and a crimp capping station, between which a separating partition is interposed, said filling station comprising a first selective handling unit designed to extract at least one individual container at a time from said first nest, align it with a dispenser for filling it, and juxtapose it against a portion of a transfer device disposed in said filling station, said crimp capping station comprising, beyond said partition, a second selective handling unit for picking up said at least one container from said transfer device, aligning the container with a crimp capping unit for coupling a crimp cap to the top of said container, and delivering the crimp capped container to a seat of a second nest.

7. The machine according to claim 6, further comprising a conveyor belt for said transport tubs, which contain said nests, from a position of alignment with a first grip element, which is designed to transfer said first nest from the respective tub arranged on the conveyor belt to said first selective handling unit, to a second position of alignment with a second grip element, for transferring said second nest from said second selective handling unit to said conveyor belt.

8. The machine according to claim 6, wherein said filling station comprises pneumatic elements for injecting conveyed/compressed gas in order to maintain, within said filling station, a pressure higher than the ambient pressure and than the pressure present in said crimp capping station.

9. The machine according to claim 6, wherein said transfer device comprises a rotating carousel disposed adjacent said partition substantially at its centerline, said carousel being provided with respective substantially perimetric seats for the temporary accommodation of said containers, a rotation of said carousel transferring the containers present in the seats arranged in said filling station beyond said partition, to said crimp capping station.

10. The machine according to claim 6, wherein said filling station comprises at least one load cell for detecting the weight of the container in either the configuration of empty container, before introducing the filling substance, or the configuration of full container, after introducing the filling substance, said load cell being arranged along the path of said first selective handling unit, substantially between a region for extracting at least one individual container at a time from said first nest and said at least one filling dispenser.

11. The machine according to claim 6, further comprising, downstream of said filling dispenser and upstream of said transfer device, an automatic stopper fitting machine for applying a stopper in the opening of said at least one container.

12. The machine according to claim 6, wherein said first selective handling unit is functionally associated with a first structure, for supporting said first nest, which can move on a horizontal plane, and with at least one first pusher, arranged below said first structure, for lifting at least one container at a time from said first nest and delivering it to said first selective handling unit.

13. The machine according to claim 6, wherein said second selective handling unit is functionally associated with a second structure, for supporting said second nest, which can move on a horizontal plane, and with at least one second pusher, arranged below said second structure, for receiving at least one container at a time from said second selective handling unit and depositing it in a respective seat of said second nest.

* * * * *